United States Patent [19]

Gross

[11] Patent Number: 4,813,803

[45] Date of Patent: Mar. 21, 1989

[54] TRIGGER MECHANISM FOR RING BINDER

[75] Inventor: Richard L. Gross, Fox River Grove, Ill.

[73] Assignee: Wilson Jones Company, Chicago, Ill.

[21] Appl. No.: 90,306

[22] Filed: Oct. 5, 1987

[51] Int. Cl.[4] ..... B42F 13/20; B42F 3/04; B42F 13/26

[52] U.S. Cl. ..... 402/38; 402/37; 402/41

[58] Field of Search ..... 402/38, 39, 41, 37, 402/40

[56] References Cited

U.S. PATENT DOCUMENTS

| | | | |
|---|---|---|---|
| 2,041,168 | 5/1936 | Dawson | 402/38 |
| 4,571,108 | 2/1986 | Vogl | 402/41 |

FOREIGN PATENT DOCUMENTS

| | | | |
|---|---|---|---|
| 711940 | 6/1965 | Canada | 402/38 |
| 2404938 | 8/1974 | Fed. Rep. of Germany | 402/38 |
| 107382 | 9/1965 | Norway | 402/38 |

*Primary Examiner*—Frank T. Yost
*Assistant Examiner*—Paul M. Heyrana
*Attorney, Agent, or Firm*—Pennie & Edmonds

[57] ABSTRACT

A loose-leaf sheet binder mechanism with a case, hinge plates, ring halves and trigger lever to operate the hinge plates for opening and closing the ring halves. The case has first lock means on it in the form of a raised or dimpled member and the trigger lever has complementary second lock means on it.

4 Claims, 3 Drawing Sheets

TRIGGER MECHANISM FOR RING BINDER

BACKGROUND OF THE INVENTION

Arrangements for holding ring binders in the closed position have been shown in prior patents (U.S. Pat. Nos. 1,927,113; 2,061,676; 3,098,490; and 4,202,719).

More recently, a locking mechanism as shown in U.S Pat. No. 3,884,586 has been used to prevent inadvertent opening of ring binders.

SUMMARY OF THE INVENTION

Broadly, the present invention is a ring binder trigger lever with a convex section of the trigger lever which has a locking means associated with such convex section to cooperate with a second locking means on the ring binder casing member.

It is a feature that the locking means are engaged by flexing and distorting the binder (within elastic limits) to lock and unlock the sheet holding rings.

DESCRIPTION OF THE PREFERRED EMBODIMENTS

Figure 1:
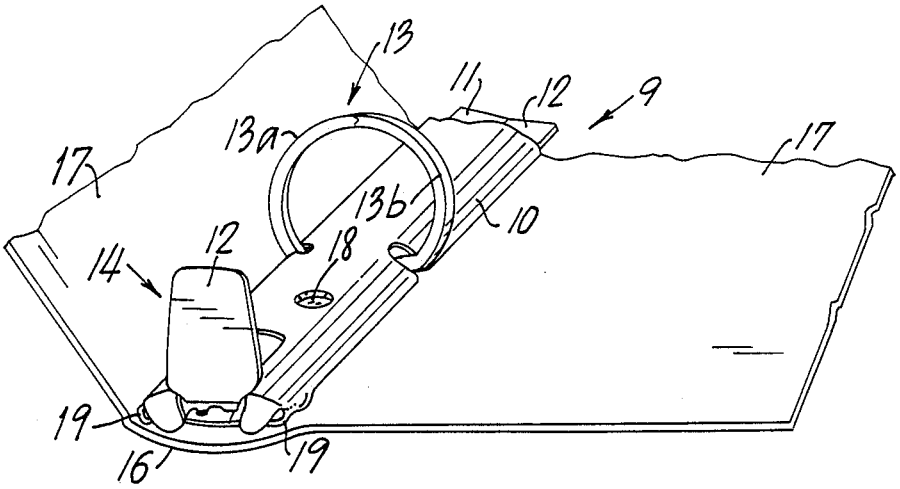
FIG. 1 is a perspective view of a portion of the trigger mechanism ring binder of the present invention.
Figure 2:
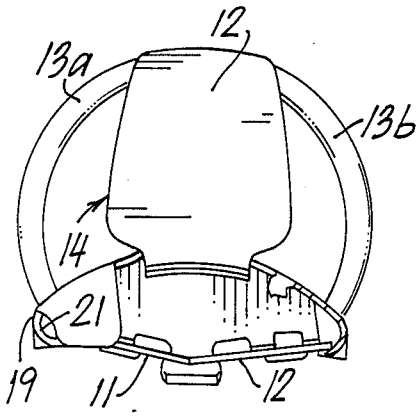
FIG. 2 is an end elevational view of the trigger mechanism in a closed position.
Figure 3:
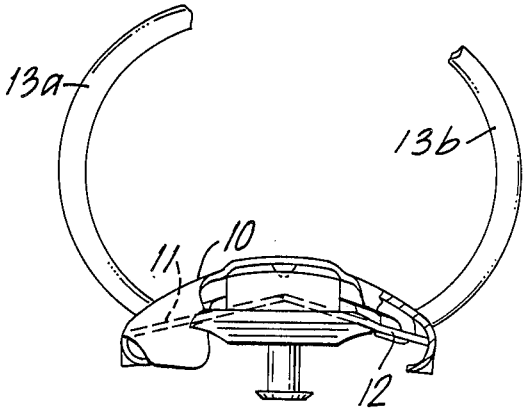
FIG. 3 is an end elevational view of the mechanism in an open position.
Figure 4:
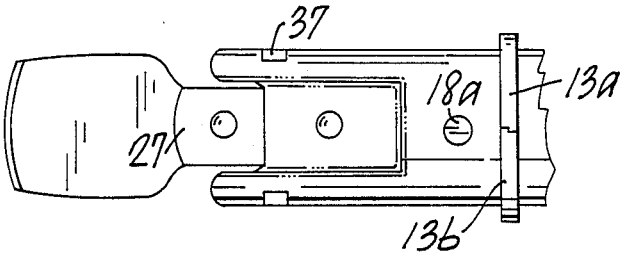
FIG. 4 is a partial plan view of the mechanism.

With reference to FIGS. 1–5, the loose-leaf binder mechanism 9 of this invention includes an elongated arched case member 10, a pair of elongated hinge plates 11 and 12 each of which carries a series of rings 13 composed of ring halves 13*a*, 13*b*, and a trigger lever 14. Binder 9 may have two, three or more rings. Case member 10 and hinge plates 11 and 12 are made of a relatively stiff spring-like metal or other suitable material The binder mechanism 9 is secured to cover spine 16 of a loose-leaf cover 17 by means of rivets 18 extending through openings 18*a* in hinge plates 11, 12 to connect case 10 and book cover 17 together. Case 10 includes longitudinal edges 19 curled to form elongated hinge pockets 21 (FIG. 2).

The inner longitudinal edges of hinge plates 11, 12 abut each other along their length. Hinge plates 11 and 12 are bowed slightly outwardly of case 10 with their upper surfaces facing toward each other in the closed position where each pair of aligned ring halves 13*a*, 13*b* forms a closed loop for retaining loose-leaf sheets appropriately punched with holes to accept the ring halves 13*a*, 13*b*. In the ring-open position (FIG. 3) hinge plates 11, 12 are bowed inwardly of case 10 with their upper surfaces facing away from each other; each pair of aligned ring halves 13*a*, 13*b* being thereby spread apart to permit insertion or removal of loose-leaf sheets.

Figure 5:
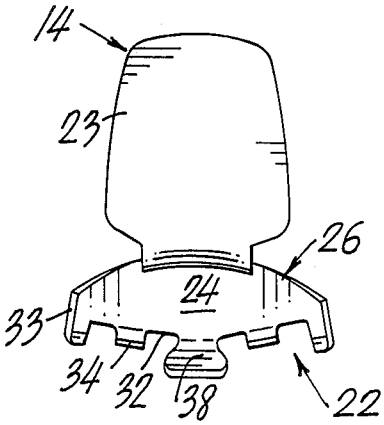
FIG. 5 is an end elevational view of the trigger lever.

Turning to FIG. 5, the trigger lever 14 includes a lower actuator portion 22 and an upper trigger portion 23. The actuator portion 22 has a transversely arched body 24 which conforms generally to the arched curvature of case 10. Body 24 extends in generally parallel offset relationship to trigger 23. The upper edge 26 of body 24 is also curved or arched transversely widthwise of case 10 with a curvature conforming generally to the curvature of arched case 10. Case-engaging and convex retaining member 27 connects the trigger lever 14 and body 24 together. End portion of case 10 includes a blister area 31 located directly over the path of movement of section 27 into case 10 during movement of the trigger lever 14 to and from its locked position. Proper clearance between section 27 and case 10 together with flexibility of case 10 to eliminate any possibility of preventing or restricting proper lever movement due to interference between convex section 27 and the case 10 blister 31 as lever 14 is moved to a locked position.

Referring again to FIG. 5, depending from each end of the lower edge 32 of body 24 are leg elements 33 and lug elements 34. The leg elements 33 engage notches 37 formed in the outer edges of hinge plates 11 and 12 (see FIG. 4) while lug elements 34 ride on plates 11 and 12. The lower edge 32 of body 24 carries a centrally located T-shaped lifting element 38 which is bent slightly toward trigger 14 and lies in an opening 41 defined by a pair of aligned notches formed along the interface between the inner edges of hinge plates 11, 12.

Figure 6:
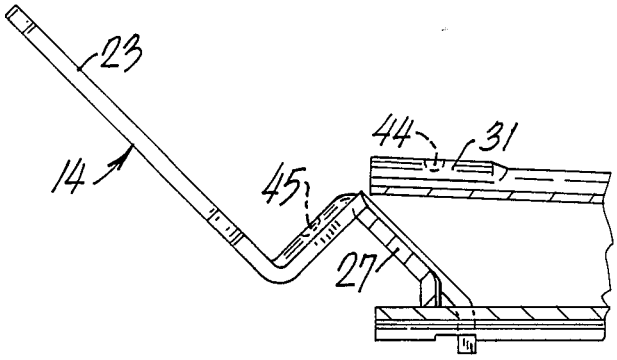
FIG. 6 is a partial side elevational view of the trigger mechanism in a disengaged position.
Figure 6B:
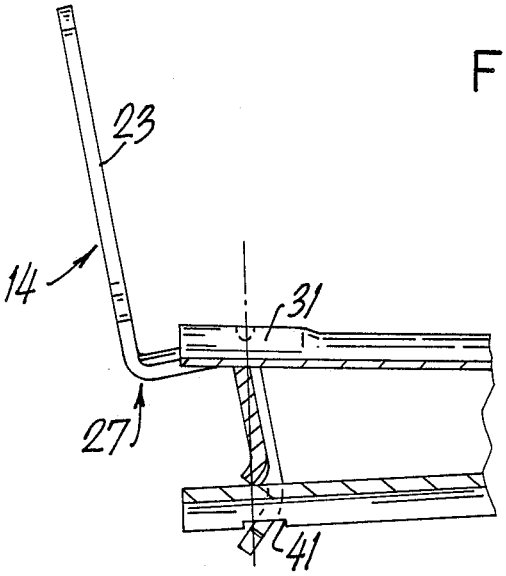
FIG. 6*b* is a partial side elevational view of the trigger mechanism in a partially engaged position.
Figure 6C:
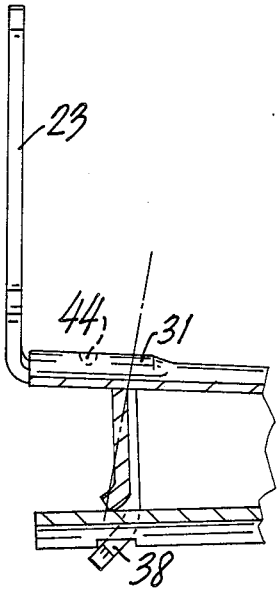
FIG. 6*c* is a partial side elevational view of the trigger mechanism fully engaged.
Figure 6A:
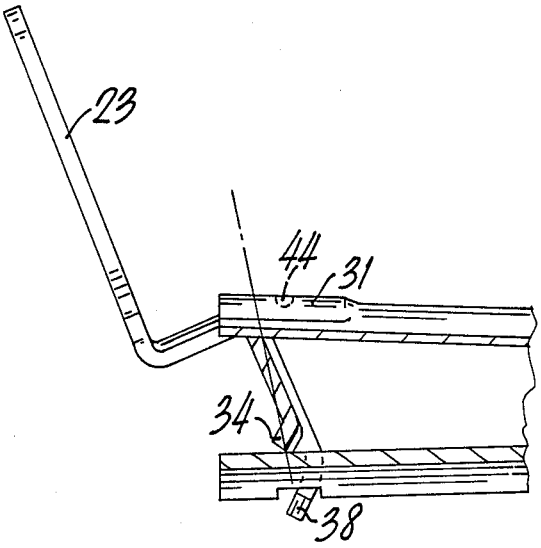
FIG. 6*a* is a partial side elevational view of the trigger mechanism in a partially engaged position.

Turning to FIGS. 6–6*a*, trigger retaining member 27 includes an indentation 45 for alignment and interaction with a dimple projection 44 projecting down below the undersurface of blister 31. Projection 44 may be formed by molding, stamping a recess in blister 31 or otherwise. Alternatively, lock projection means may be formed on the trigger lever with a mating lock recess in the blister. The cooperation of the two (2) lock means provides greater resistance to the binder opening when dropped or otherwise subjected to large forces.

In operation of the mechanism, upper trigger portion 23 is operated to move case-engaging and retaining member 27 from its disengaged position (FIG. 6) to its engaged position (FIG. 6*c*). The trigger lever 14 including its member 27 is held in its lock or closed position by close positioning of member 27 to blister 31 and by location of dimple projection 44 in indentation 45. To move trigger lever 14 to its unlock or open position sufficient force is required to be applied to trigger portion 23 to distort, bend and flex case 10, blister 31, plates 11, 12 and other parts of the mechanism to allow projection 44 to move out of indentation 45.

Figure 7:
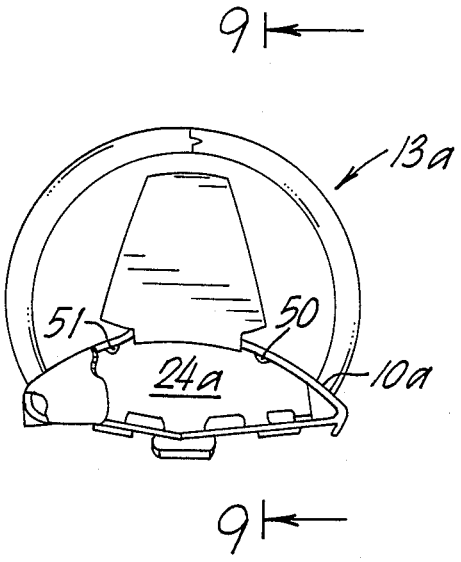
FIG. 7 is an end view of an alternative trigger mechanism.
Figure 9:
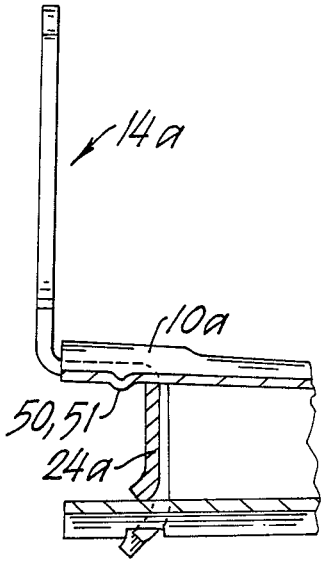
FIG. 9 is a sectional view taken along line 9—9 of FIG. 7.
Figure 8:
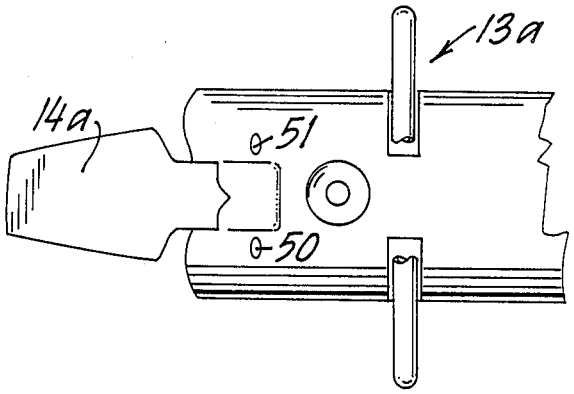
FIG. 8 is a partial plan view of the alternative mechanism.

Turning to FIGS. 7–9, trigger lever 14*a* may be held in its closed position by two (2) case dimples 50, 51 formed in and protruding down from the underside of case 10*a*. During operation of this embodiment, as trigger lever 14*a* including curved body portion 24*a* is moved from an open position (FIG. 8) to a closed position (FIG. 9), trigger lever body portion 24*a* initially engages case dimples 50, 51; cams past them as case member 10*a* and hinge plates 11*a*, 12*a* deform to permit such passage and finally body portion 24*a* comes to rest beyond dimples 50, 51 which dimples 50, 51 hold the body portion 24*a* in locked position. If desired, any number of dimples can be used such as one dimple, on one side or the other, or three or more dimples. If desired, the dimple arrangement of FIGS. 1–6 may be used together with the arrangement of FIGS. 7–9.

I claim:

1. In a loose-leaf sheet lock mechanism having a case member, a pair of elongated hinge plates, ring halves mounted on the plates operable to form loose-leaf retaining rings, a trigger lever operable to move the plates from an open ring position to a closed ring position, the improvement comprising blister means on said case member;

a convex section of trigger lever for positioning in and engagement with such blister means;

first locking means formed in the blister means of the case member; and a second locking means on the trigger lever for interacting with the first locking means when the trigger lever is moved against the blister means.

2. The improvement of claim 1 in which the first lock means is a projection and the second lock means is a dimple recess.

3. The improvement of claim 2 in which the projection is formed by stamping a recess in the blister means.

4. The improvement of claim 1 in which the first lock means is a projection means on one side of the blister means, and the second locking means is an arched body means of the trigger lever.

* * * * *

UNITED STATES PATENT AND TRADEMARK OFFICE

CERTIFICATE OF CORRECTION

PATENT NO. : 4,813,803

DATED : March 21, 1989

INVENTOR(S) : Richard L. Gross

It is certified that error appears in the above-identified patent and that said Letters Patent is hereby corrected as shown below:

Column 1, line 7, "4,202,719)." should read --3,101,719).--.

Signed and Sealed this

Fourteenth Day of November, 1989

*Attest:*

JEFFREY M. SAMUELS

*Attesting Officer*

*Acting Commissioner of Patents and Trademarks*